United States Patent [19]

Squire et al.

[11] Patent Number: 4,645,237

[45] Date of Patent: Feb. 24, 1987

[54] BINDER ASSEMBLY FOR PUBLICATIONS AND RETAINERS FOR SAME

[76] Inventors: Molly A. Squire, Box 1323, Claremont, Calif. 91711; Wasyl Sawicki, 1714 Granville Ave., Los Angeles, Calif. 90025

[21] Appl. No.: 595,046

[22] Filed: Mar. 30, 1984

[51] Int. Cl.[4] ..... B42D 17/00; B42F 1/00; B42F 7/00

[52] U.S. Cl. ..... 281/47; 281/45; 281/46

[58] Field of Search ..... 281/15 B, 20, 21 A, 281/45, 46, 47

[56] References Cited

U.S. PATENT DOCUMENTS

| | | | |
|---|---|---|---|
| 534,837 | 2/1895 | Marble | 281/47 |
| 1,405,818 | 2/1922 | Dickerson | 281/47 |
| 1,474,494 | 11/1923 | Schade | 281/47 |
| 1,936,704 | 11/1933 | Zieschang | 281/47 |
| 2,016,588 | 10/1935 | Bloore et al. | 281/47 |
| 2,197,235 | 4/1940 | Basher | 281/47 |
| 2,233,687 | 3/1941 | Vale | 281/47 |
| 2,323,123 | 6/1943 | Donato et al. | 281/47 |
| 2,960,090 | 11/1960 | Shugart | 281/47 |

*Primary Examiner*—Paul A. Bell
*Assistant Examiner*—Paul M. Heyrana, Sr.

[57] ABSTRACT

Retainers and a binder assembly including the retainers are provided for detachably mounting publications having double leaves with folds intermediate their edges and the binder having two spaced fastener members. Each retainer has an elongated rod section, a u-shaped section at each end with distal portions extending toward each other, and a loop defined on each distal end portion and spaced apart to register with the spaced fastener members, thus to detachably mount publication leaves on the retainers by introduction of respective retainers between the leaves of respective groups to retain the group of leaves on the retainer by engagement of the retainer with said folds.

8 Claims, 4 Drawing Figures

BINDER ASSEMBLY FOR PUBLICATIONS AND RETAINERS FOR SAME

BACKGROUND OF THE INVENTION

The present invention relates in general to filing of documents and more particularly to an improved method of retaining same in notebook and binder devices.

This invention relates to files for magazines, booklets, pamphlets and the like and has for its main object to provide improved appliances for rather different filing purposes which are easy to handle, practical in use, elegant in appearance and easy to select when put together in an archive but which are yet inexpensive to manufacture.

DESCRIPTION OF THE PRIOR ART

Heretofore, retention of periodicals, pamphlets, and the like within binder devices was accomplished by clamps or required punching holes in the document for retention on rings, posts, or other male receptacle fastening devices within the file binder. Frequently, the document or periodical is too thick for such holes to be punched and the document has been stored loosely on the shelf, in a storage rack, or in a filing cabinet. Publishers produce receptacles specifically sized and designed to fit their periodicals for persons desirous of saving back issues. Documents of differing sizes on a related topic are not able to be stored together, necessitating further searching by the interested readers. The call numbers of library cataloging frequently have been written on the cover of documents and pamphlets and are not visible from the bound edge, hence the material has been difficult to locate. Basically in accordance with our invention, we provide a holder for bound sheetlike materials wherein the materials are easily insertable and removable from notebooks or file binders, wherein the materials can be viewed conveniently and easily without removal, wherein the holder can be stored in a minimum storage space when not being used, several documents of various sizes on the same topic can be gathered attractively and bound in a convenient form, and wherein the holder is readily adaptable for use with a wide range of sizes of materials. Our holder generally comprises a wire frame of one elongate piece with the ends forming parallel loops at either end for retaining pamphlets and the like and cuminating in two closed circular loops spaced to receive the two outer male posts or ring receptacles in a notebook binder device.

SUMMARY OF THE PRESENT INVENTION

The advantages and objects of the invention are attained by retainers and a binder assembly which includes the retainers, for the detachable mounting of publications comprising one or more double leaves having folds intermediate their edges, the binder having two spaced fastener members, and each retainer having an elongated rod section, a generally u-shaped section extending from each end of the rod section, the end sections having distal portions extending generally toward each other, and a loop defined on each distal end portion of each u-shaped section, the loops being spaced apart the same distance as the fastener members to register therewith so that the loops are received on the fastener members. The pluraity of publication leaves are mountable on the retainers by introduction of a respective retainer between the leaves of a respective group of leaves to engage the retainer rod section with the vertical fold of the group of leaves.

The fastener members may be conventional openable and closable looseleaf rings, or conventional binder posts. The retainers may be formed from rod material and the u-shaped sections and loops formed integrally therewith. The retainers may be formed of heavy gauge wire and the u-shaped sections and loops formed by bending. The retainers may be fabricated of flat strip material by molding, typically of thermoplastic material, or the retainers may be formed of metal or plastic by stamping.

The principal object of the present invention is the provision of an improved method of retaining documents within notebooks and file binders, and method of making same.

It is an object of the invention to provide novel and improved means of use of file binders and document holders in order to provide broader utility to standard sized binders and notebooks and easier access and storage of multiple sizes of soft cover documents. A further object of our invention is to have simple and efficient means for detachably mounting pamphlets, periodicals, and the like for filing and viewing.

The design has been found advantageous because (1) It eliminates the need to buy periodical files specifically designed to fit various size periodicals and which are above current minimum market coasts of standard file binders. (2) The retention device is stiff enough to support the documents in place without sagging or allowing them to tear out of the notebook. (3) It is not necessary to punch holes for retention in thick booklets, etc., which is normally extremely difficult but necessary when one wants to retain bound documents with soft covers, of various sizes, in a group or subject file binder. (4) When filing groups of documents of related subject matter of various sizes the documents can be grouped and filed in a more orderly filing fdashion than heretofore. (5) The production costs have been found to bne minimal, adding to the feasibility and desirability of reproducing the retention device. (6) The design is energy efficient and uses minimum materials for retention. (7) Reproduction of this file retention device will aid in filing small documents and pamphlets, reducing the need for a separate file or a filing cabinet. Documents can be stored on ordinary bookshelves in an orderly fashion. Loss of loose documents will be reduced. (8) The file retention device does not need to be reproduced of formed wire but can be of pressed metal or similar hard substance such as a resistant nonbending structural cardboard, fiberboard, or a plastic or similar sheet material.

DESCRIPTION OF THE PREFERRED EMBODIMENTS

Figure 1:
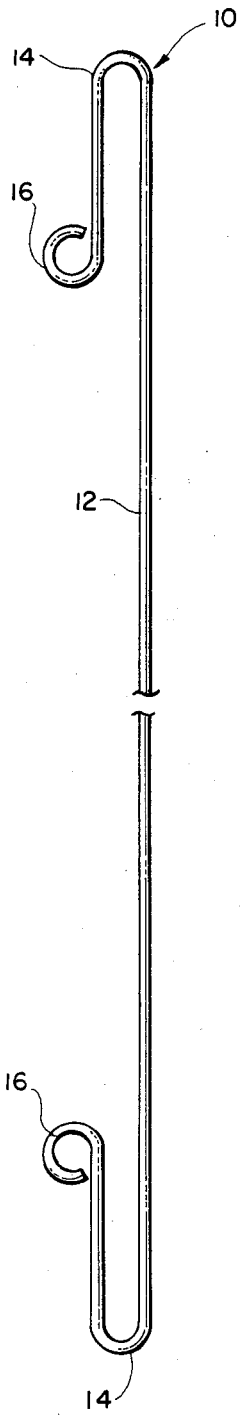
FIG. 1 is a full frontal viw of a preferred type of file retention device of wire to be utilized in a notebook binder or file receptacle according to the invention.

Referring to the drawings, a preferred embodiment of the invention 10 is shown in FIG. 1 as comprising an elongated rectilinear rod section 12 of circular cross-section, U-shaped end sections formed integrally with the rod section, as by bending, the u-shaped sections 14 having distal portions which extend toward each other and which have formed thereon loops 16, 16 which are spaced apart a distance corresponding to the space or distance between fastener elements, typically the rings of a looseleaf binder notebook or the binder posts or a post binder. This spacing may typically be that of the spacing between the rings of a conventional looseleaf notebook. The retainer may be formed of heavy gauge wire and the U-shaped section 14 loops 16 may be formed by bending. The retainer 10 may also be formed by molding or other appropriate method.

Figure 2:
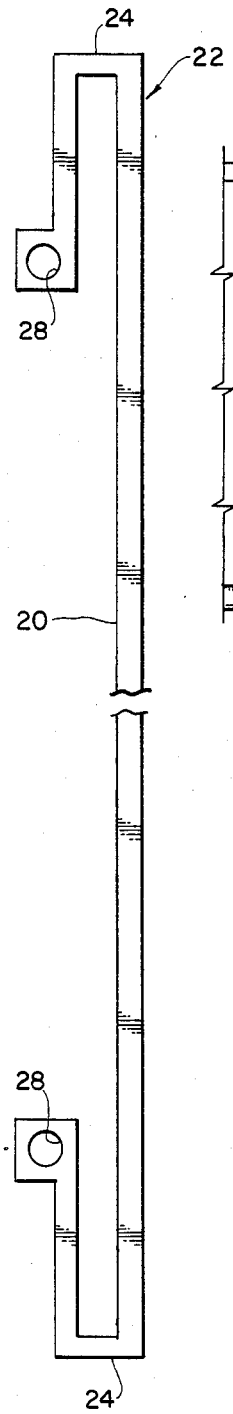
FIG. 2 is a full frontal view of the file retention devicew shown in FIG. 1, butr of pressed metal or a similar hard substance to be used in a ring or post binder device for documents according to the invention.

FIG. 2 illustrates another preferred form of the invention having the configuration of a flat strip, which may be formed of thermoplastic material or other appropriate material by molding, or may be formed of appropriate emetal or other material by stamping. The retainer 22 has an elongated rod section 20, U-shaped end sections 24 and distal sections having loops or openings 28 formed therein. The retainer 22 is of generally flat cross-section throughout.

Retainer structure must be of relatively stiff construction in order to retain its configuration while withstanding the stress and forces of relatively heavy publication leaves, such as magazines or heavy documents. Although the preferred forms are fabricated of heavy gauge wire, rod or flat strips or thermoplastic material or metal, the retainer may also be fabricated of plastic with wire embedded therein to provide reinforcement, as by molding or pressing.

Figure 3:
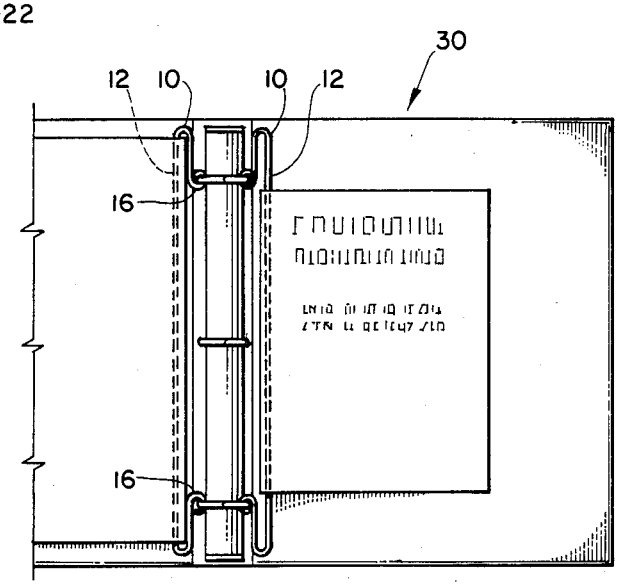
FIG. 3 is an open view of the binder assembly in use, with several retainers retaining various size documents within one binder.

FIG. 3 shows a binder assembly 30 according to the invention, includes a plurality of retainers 10 according to the invention detachably mounted in a binder by engagement of the loop portions of the retainers on the fastener assemblies of the binder. The leaves of respective groups are engaged on a respective retainer by insertion of the retainer between the leaves and engagement of the rod section 12 with the fold of the group of leaves.

Figure 4:
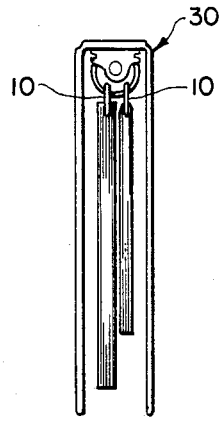
FIG. 4 is an end view of binder assembly in use, showing several retainers in use.

FIG. 4 shows the binder assembly 30 with two retainers 10 inside a binder as seen from the open end of the binder.

Each of the retainers is separately removable from the binder assembly to remove the publication leaves therefrom, or where appropriate, leaves may be removed from the retainer without removal of the retainer from the fastener assemblies.

We claim:

1. A retainer for the detachable mounting of publications having one or more double leaves with vertical folds intermediate their edges, in a binder having three spaced-apart rings, said retainer comprising:

an elongated rectiliner retainer rod section of substantially equal length with respect to said binder extending across all three of said loops;

a generally U-shaped ring mounting section extending from each end of the elongated rod section, said end ring mounting sections having distal portions extending generally toward each other and generally parallel to the elongated rod section;

a loop on the distal end portion of each of said U-shaped sections, said loops being spaced apart to register with the outermost ones of said three spaced-apart rings so as to bypass the middle ring of said three rings;

whereby a plurality of said publication leaves are mountable on the retainer rod section in close proximity to said bypassed ring by introduction of the retainer rod section between the leaves to engage the elongated retainer rod section with said vertical folds.

2. A retainer according to claim 1, wherein: the retainer is a stamped flat strip.

3. A retainer according to claim 1, wherein:

the retainer is a length of thermoplastic material.

4. A retainer according to claim 1, wherein the retainer is formed of heavy gauge wire by bending.

5. A binder assembly for detachably mounting publications having one or more double leaves with folds intermediate their edges in a binder, said binder assembly comprising:

said binder having at least three spaced apart openable and closable looseleaf rings aranged in a row;

at least one retainer for engaging the double leaves to retain the leaves of a publication in said binder;

each retainer comprising an elongated retaining rod section extending from two outer of said three rings and across the third inner of said rings;

a generally U-shaped ring mounting section extending from each end of the retaining rod section, the distal portions of the U-shaped mountings sections extending toward each other to terminate at the respective outer two rings;

a loop defined on the distal end portion of each of the U-shaped mounting sections, said loops being spaced apart the same distance as said spaced outer two rings for registration therewith: and whereby a plurality of publication leaves are detachably mountable in said binder by engagtement of respective retainer ring rod section with respective double leaves by engagement of said retainer rod section between double leaves.

6. A retainer according to claim 5, wherein:

the retainers are elongated rods and said U-shaped mounting sections and loops are integrally therewith.

7. A retainer according to claim 5, wherein:

the fastener members are openable and closable looseleaf rings.

8. A retainer according to claim 5, wherein:

the retainer is formed from an elongated retaining rod and said U-shaped mounting sections and loops are formed integrally therewith.

* * * * *